US005567381A

United States Patent [19]

Carter

[11] Patent Number: 5,567,381

[45] Date of Patent: Oct. 22, 1996

[54] HYBRID HEAT TREATING FURNACE

[75] Inventor: Matthew D. Carter, Portland, Oreg.

[73] Assignee: Abar Ipsen Industries, Inc., Bensalem, Pa.

[21] Appl. No.: 407,407

[22] Filed: Mar. 20, 1995

[51] Int. Cl.[6] ..... C21D 1/74

[52] U.S. Cl. ..... 266/250; 266/252; 432/128

[58] Field of Search ..... 266/249, 250, 266/252, 259; 432/128, 163, 207, 208

[56] References Cited

U.S. PATENT DOCUMENTS

| | | | |
|---|---|---|---|
| 1,699,784 | 1/1929 | Fuchs | 266/250 |
| 1,876,960 | 9/1932 | Kenworthy | 266/250 |
| 2,446,403 | 8/1948 | Bassereau | 266/252 |
| 3,014,708 | 12/1961 | Helin | 266/250 |
| 3,399,875 | 9/1968 | Ipsen | 266/250 |
| 3,431,346 | 3/1969 | Western et al. | 266/249 |
| 3,522,357 | 7/1970 | Pine et al. | 266/250 |
| 3,609,295 | 9/1971 | Bielefeldt | 219/405 |
| 3,866,891 | 2/1975 | Kalbfleisch | 266/250 |
| 4,445,849 | 5/1984 | Bouille | 432/128 |
| 4,647,017 | 3/1987 | Stainbrook | 266/250 |
| 4,758,157 | 7/1988 | Hailey | 432/128 |
| 4,932,864 | 6/1990 | Miyabe | 432/128 |
| 5,052,923 | 10/1991 | Peter et al. | 266/250 |

FOREIGN PATENT DOCUMENTS

| | | | |
|---|---|---|---|
| 1084923 | 9/1955 | Germany . | |
| 6-1744377 | 6/1994 | Japan | 432/128 |

*Primary Examiner*—Scott Kastler

*Attorney, Agent, or Firm*—Dann, Dorfman, Herrell and Skillman, P.C.

[57] ABSTRACT

A hybrid furnace includes a vacuum furnace for heat treating a workpiece and a transportable oven removably attached to the vacuum furnace for holding the workpiece and maintaining it at an elevated temperature. The workpiece is transferred from the vacuum furnace to the transportable oven under an inert atmosphere to prevent the workpiece from being exposed to an oxidizing atmosphere or from undergoing a phase transition. The transportable oven is adapted to be detached from the vacuum furnace and transported to a work station for further processing of the workpiece. Heating means is provided in the transportable oven to maintain the temperature of the workpiece above a preselected warming temperature while the workpiece is waiting to be processed.

16 Claims, 9 Drawing Sheets

HYBRID HEAT TREATING FURNACE

FIELD OF THE INVENTION

This invention relates to heat treating furnaces and in particular to a vacuum furnace adapted for heat treating a metallic workpiece and maintaining the workpiece within a desired temperature range prior to hot or warm working thereof.

BACKGROUND OF THE INVENTION

Vacuum furnaces are known and used for heat treating metallic workpieces at temperatures in excess of 1500° F. At such temperatures the metallic workpieces are highly reactive and scale forms easily on the surfaces of the workpieces when they are exposed to air. Scale adversely alters the surface of the workpieces, and if the workpieces are to be hot formed, the scale interferes with the forming process. Therefore, in most situations the scale must be removed and is usually removed by an expensive process involving the use of hazardous chemicals.

Some alloys undergo a phase transition when cooled from the heat treating temperature to below a certain temperature, typically in the range of 300° to 650° F. Once the material undergoes this phase change, it is substantially less ductile and is more difficult to mechanically work such as by forging or rolling. Therefore, many such alloys must be mechanically worked above the phase transition temperature.

Two stage heat treating furnaces are well known in the art. The two stage furnace avoids the problem of scale formation because the metallic workpieces are cooled to room temperature in the furnace without exposing them to air. A typical two stage furnace has a heating chamber and an adjoining quenching chamber. The heating chamber is typically enclosed in a vacuum vessel and the quench chamber may also be enclosed in a vacuum chamber or it may be enclosed in a pressure vessel to facilitate cooling by an inert gas under positive pressure. The workpieces are heated to an elevated temperature in the heating chamber and are then transferred to the quench chamber where they are cooled. Typically, the workpieces are quenched rapidly, such as by immersion in oil.

While a two stage furnace avoids the scale formation problem associated with heat treated metallic parts, it has limited usefulness when the workpieces are to be hot or warm worked after heat treatment. The known two stage furnaces are unsatisfactory in such processes because they are designed to fully cool the heat treated workpieces. While it is known to reheat a metallic workpiece to its hot working temperature range, such a step necessarily adds considerable time and expense to the manufacturing process. Additionally, for many materials, reheating the material to the hot working temperature range will not reverse the effects of the phase change. The material must be reheated to a solution temperature, which is generally significantly higher than the hot working temperature range. To avoid the additional time and expense of reheating the workpieces to the hot forming temperature, it is preferable to maintain the workpiece at the desired working temperature in the time between completion of the heat treatment and the start of the hot forming process.

For a workpiece to be properly hot formed, the workpiece must be at an elevated temperature within its hot working temperature range. Frequently the temperature at which the workpieces must be maintained is critical and cannot fluctuate significantly. If the temperature of the workpiece falls below a critical lower temperature, the workpiece is likely to crack or otherwise be damaged during the hot working process.

The known two-stage heat treating furnaces leave something to be desired for handling workpieces that are to be hot formed because most of the two-stage furnaces include quench chambers, thereby necessitating reheating of the workpieces prior to hot working them. Additionally, the known heat treating furnaces that do not include a quench chamber have no means for maintaining the workpiece at an elevated temperature without exposing the workpiece to air once it leaves the furnace.

SUMMARY OF THE INVENTION

The problems associated with the known heat treating furnaces are solved to a large degree by a hybrid vacuum furnace in accordance with the present invention and a method for heat treating a metallic workpiece that utilizes said furnace. In accordance with one aspect of the present invention there is provided an apparatus for heat treating a metallic workpiece which includes generally a vacuum furnace, sealing means, and a transportable oven. More specifically, the hybrid vacuum furnace of the present invention includes a vacuum furnace for heating a metallic workpiece to a first elevated temperature. The vacuum furnace itself includes a heating chamber and an opening for inserting a metallic workpiece into or removing it from the heating chamber. A sealing means is connected to said vacuum furnace for closing the vacuum furnace opening and preventing the introduction of air into the heating chamber while the workpiece is being heated in said vacuum furnace. A transportable oven is removably connected to said sealing means and includes an oven chamber for holding the workpiece. The oven chamber has an opening at one end thereof for inserting a workpiece into or removing it therefrom. Oven closing means is provided for closing the opening of said oven chamber and for preventing the introduction of air into the oven chamber when the oven is disconnected from the vacuum furnace. The transportable oven further includes a heating means for maintaining the workpiece in said oven chamber above a second elevated temperature when said oven is disconnected from the furnace.

In accordance with another aspect of the present invention there is provided a method for heat treating a metallic workpiece and transferring the workpiece from a vacuum furnace to a processing station without exposing the workpiece to an oxidizing atmosphere. The process includes the step of heating the workpiece to a first elevated temperature and cooling it to a second elevated temperature lower than the first elevated temperature in the vacuum furnace. The workpiece is then transferred to a transportable oven while the workpiece is at the second elevated temperature. The transferring step is conducted without exposing the workpiece to an oxidizing atmosphere such as air. Closing the transportable oven to prevent the workpiece from being exposed to an oxidizing atmosphere when the transportable oven is disconnected from the vacuum furnace. The transportable oven is then transported to a processing station, such as a forge or press, and the workpiece is heated in the transportable oven while it is at the processing station to maintain the workpiece above the second elevated temperature.

BRIEF DESCRIPTION OF THE DRAWINGS

The foregoing summary, as well as the following detailed description of a preferred embodiment of the present invention, will be better understood when read in conjunction with the accompanying drawings, in which.

DETAILED DESCRIPTION OF THE PREFERRED EMBODIMENTS

Figure 1:
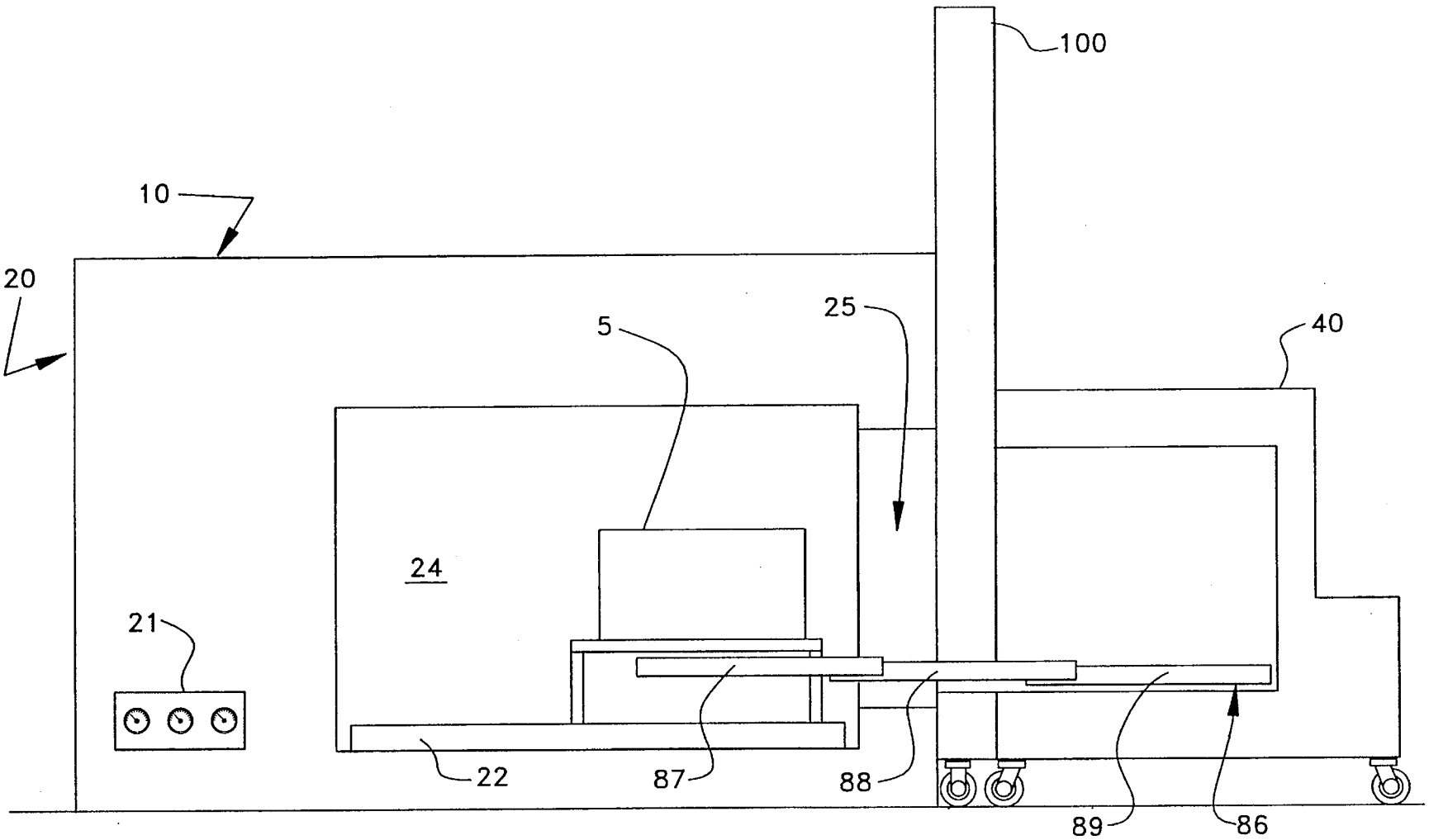
FIG. 1 is a side elevation view of a hybrid vacuum furnace in accordance with the present invention.

Referring now to the drawings, and in particular to FIG. 1 there is shown a hybrid furnace 10. The hybrid furnace includes a vacuum furnace 20 and a transportable oven 40. The vacuum furnace 20 has a heating chamber 24, in which a workpiece 5 is heated to an elevated temperature, for example, to a temperature above 1500° F., under subatmospheric pressure. The vacuum furnace 20 includes heating controls 21 to set and control the temperature of the workpiece 5 in the heating chamber 24. An opening 25 at one end of the vacuum furnace 20 provides access to the heating chamber 24 so that parts can be inserted thereinto or removed therefrom.

The vacuum furnace 20 also includes a vacuum pump (not shown) and an inert gas supply (not shown). The vacuum pump evacuates the heating chamber 24 so that the furnace can be operated under a subatmospheric pressure. The inert gas supply provides inert gas such as nitrogen or argon for injection into the heating chamber 24 to provide an inert atmosphere therein during a cooling cycle. The details of such a furnace are described more fully in U.S. Pat. No. 4,141,539, which is herein incorporated by reference.

A gate valve assembly 100 is affixed to the vacuum furnace 20 at the opening 25 to provide a means for sealing the opening 25 and prevent air leakage into the vacuum furnace 20 when it is operating at a subatmospheric pressure. Gate valve assembly 100 also provides an interface with the transportable oven 40. The construction of the gate valve assembly 100 is described in greater detail hereinbelow.

The transportable oven 40 has an opening 50 formed in one end thereof and dimensioned to provide access to the oven chamber 45 so that a workpiece 5 can be inserted into or removed from the oven chamber 45. Transportable oven 40 is removably attached to the gate valve assembly 100.

When the transportable oven 40 is attached to the gate valve assembly 100, the oven opening 50 is in communication with the furnace opening 25 through the gate valve assembly 100 thereby allowing the workpiece 5 to be transferred by a transfer mechanism 86 between the furnace chamber 24 and the oven chamber 45. The transfer mechanism 86 is anchored in the oven chamber 45 and is constructed and arranged to extend into the heating chamber 24 to lift the workpiece 5 and retract into the oven chamber 45 with the workpiece.

As shown in FIGS. 1, 2, 8 and 9, the transfer mechanism 86 comprises three frames: an upper frame 87, a middle frame 88, and a lower frame 89. The three frames cooperate with one another via a series of rollers 95. A push bar 97 is rigidly connected to one end of the middle frame 88 of the transfer mechanism 86. The push bar 97 is also connected to a drive chain 96 that is driven by two drive sprockets 99, one of which **99*a*, is rotated by a drive motor 91**.

Figure 4:
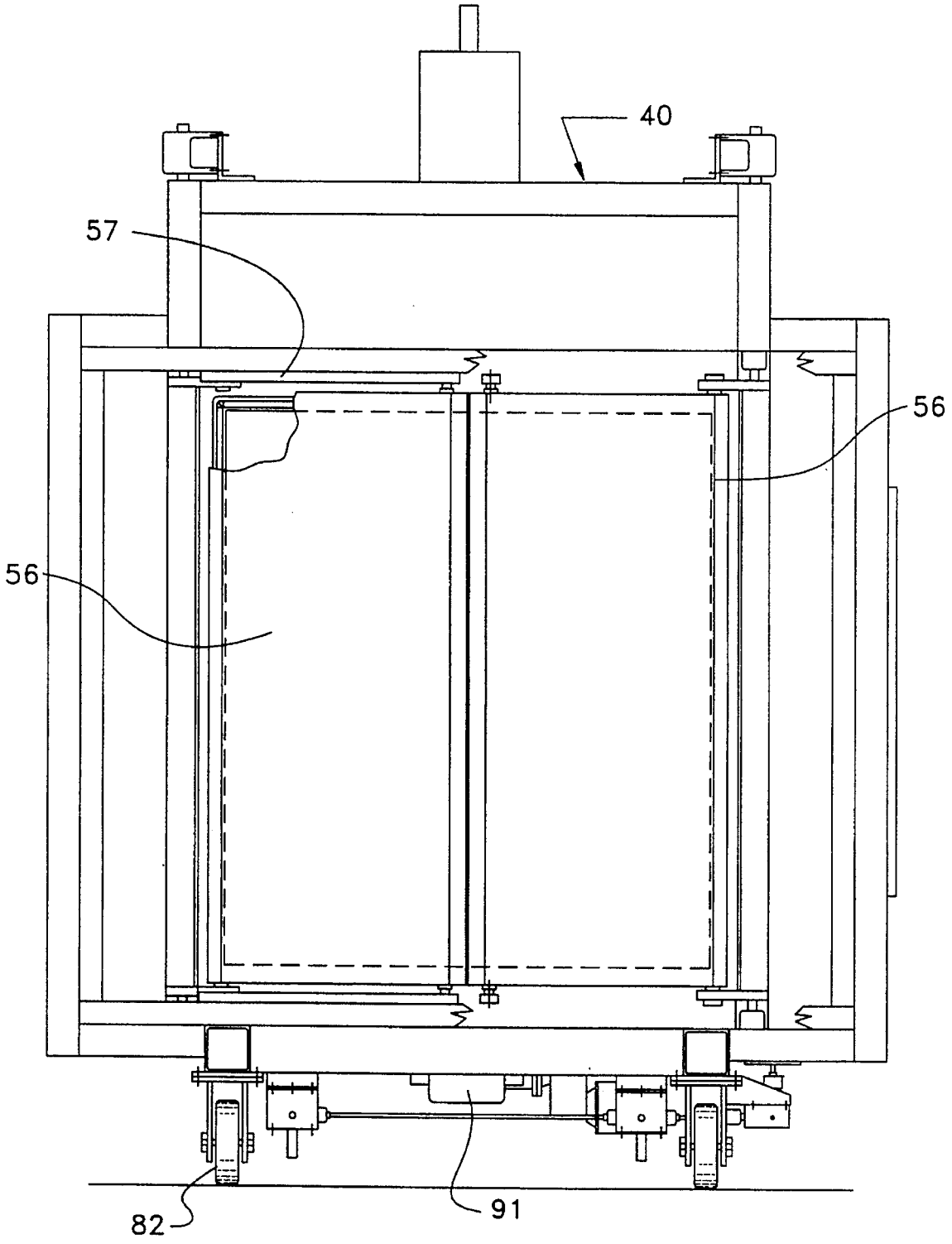
FIG. 4 is a front elevation view partially in section of the transportable oven shown in FIG. 2.

When the drive motor 91 (see FIG. 4) operates in the forward direction, the drive chain 96 acts on the push bar 97 to longitudinally extend the middle frame 88. In the embodiment shown, the drive chain 96 travels in a counter-clockwise direction to extend the middle frame toward the left end of the lower frame 89.

An extension chain 98 is operatively connected to the lower and upper frames of the transfer mechanism for extending the upper frame 87 beyond the middle frame 88. One end of extension chain 98 is connected to an end of the lower frame 89, preferably the end nearest the oven opening 50. Another portion of the extension chain 98 is connected to an end of the upper frame 87, preferably the end distal from the oven opening 50. The extension chain 98 is supported in driving engagement by two sprockets **94*a* and 94*b* which are mounted on opposite ends of upper frame 87 and can freely rotate. The upper frame 87 is supported on the middle frame 88 by the rollers 95. With this arrangement, as the middle frame 88 extends toward the opening 50, a pulling force is exerted on the upper frame 87 by the extension chain 98 which causes the upper frame 87 to move relative to the middle frame 88, thereby extending the upper frame 87 beyond the middle frame 88**.

Figure 3:
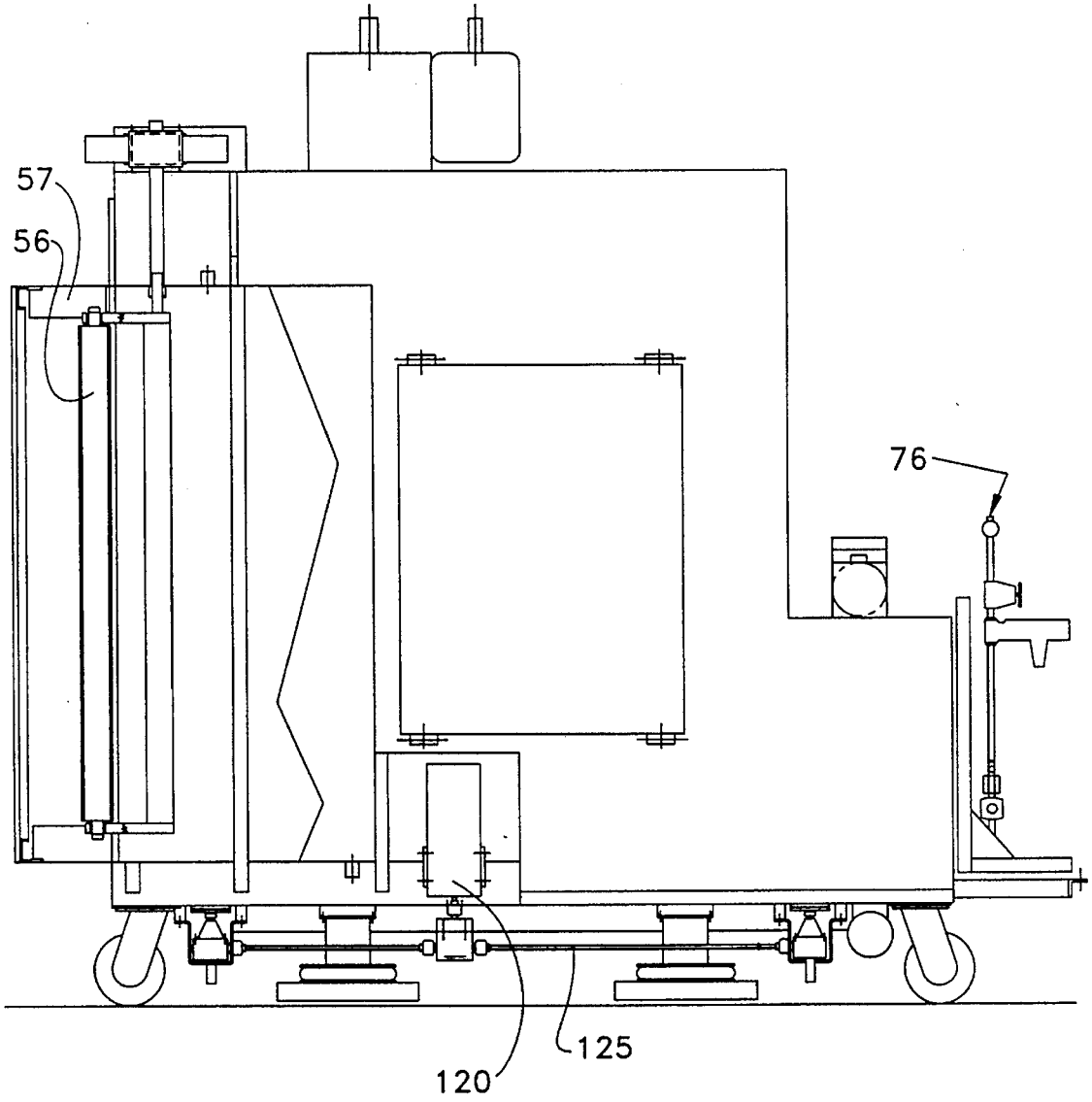
FIG. 3 is a side elevational view in partial section of the transportable oven in FIG. 2.

When the transfer mechanism 86 is fully extended into the heating chamber 24 of the furnace 20, the upper frame 87 is located beneath the workload. A lifting motor 120 turns a series of connecting rods 125 connected to a series of jack screws 130 (see FIG. 3). As the jack screws 130 are rotated, the transfer mechanism 86 is raised to contact and lift the workpiece 5. The transfer mechanism 86 is then retracted into the oven chamber 45 by reversing the direction of the drive motor 91, and the workpiece is lowered by reversing the direction of the lifting motor 120.

Figure 2:
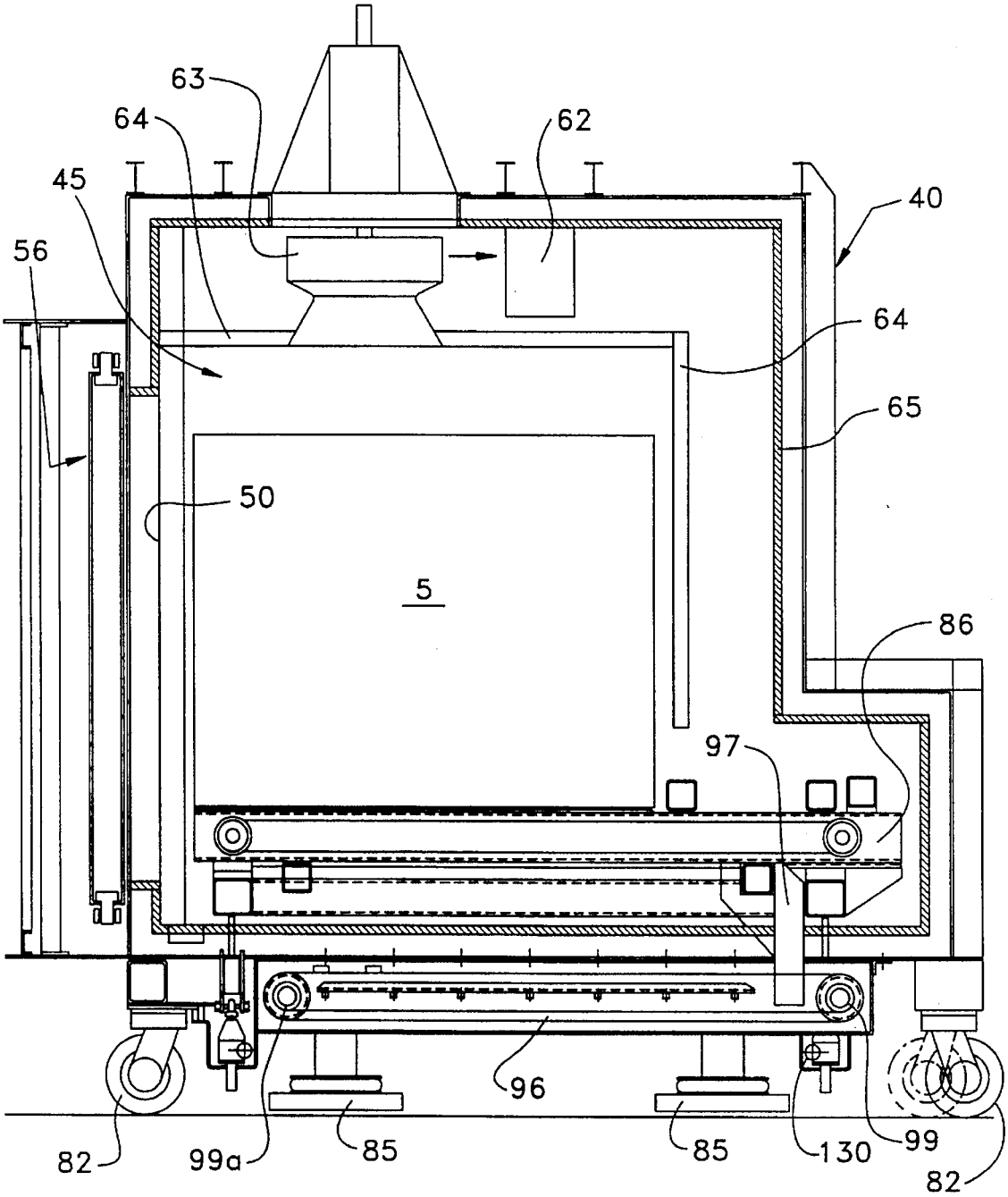
FIG. 2 is a side elevation view in partial section of a transportable oven used in connection with the hybrid vacuum furnace shown in FIG. 1.
Figure 5:
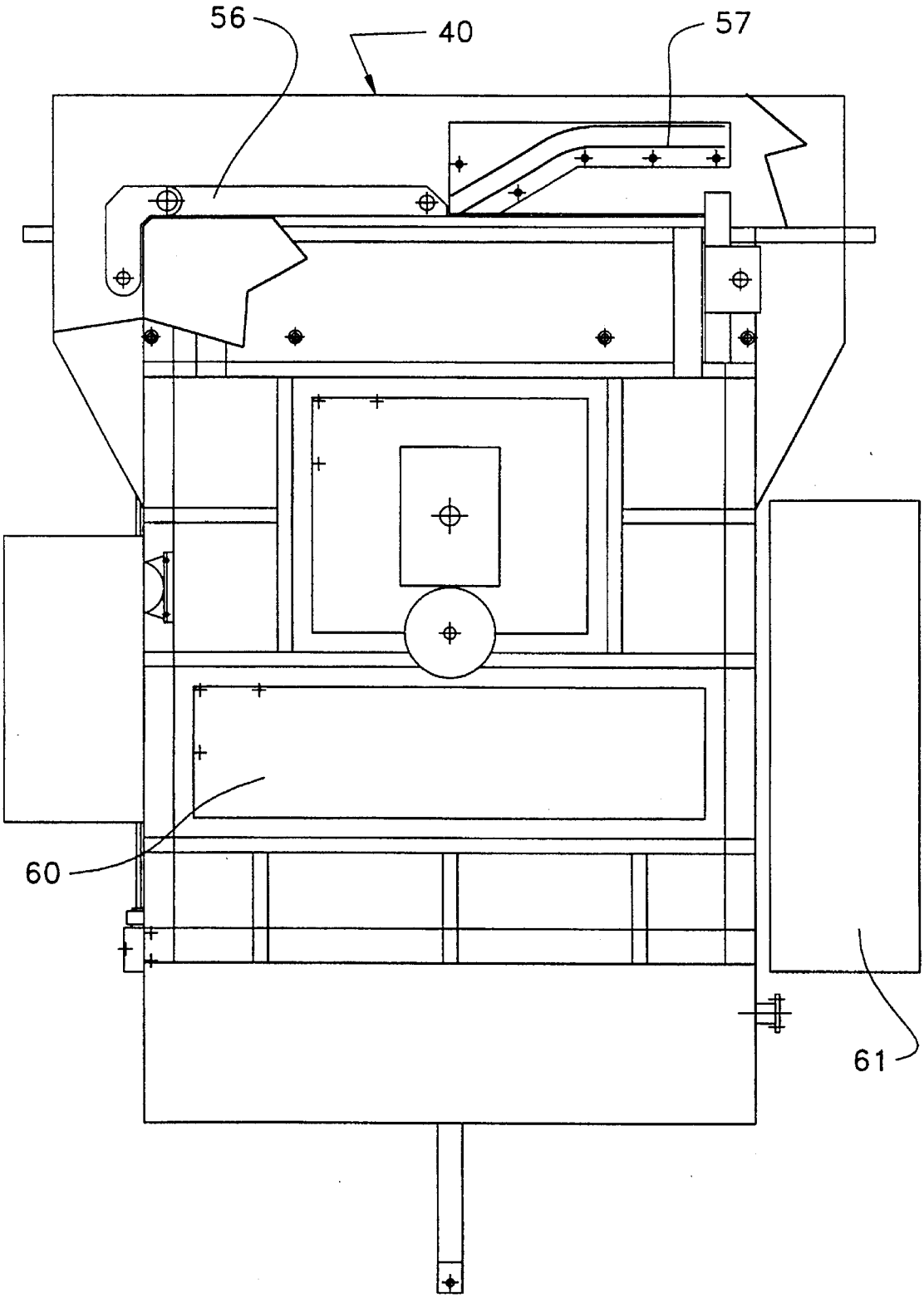
FIG. 5 is a top plan view of the transportable oven shown in FIG. 2.

Referring now to FIGS. 2 and 5, the transportable oven 40 further includes heating means for maintaining a workpiece at an elevated temperature and gas supply means for providing an inert gas atmosphere in the oven chamber 45. In the embodiment shown, the oven gas supply comprises a gas connector and an inert gas reserve system 76. The gas connector is adapted for connecting the oven chamber 45 to a remote supply of inert gas 20 whereby pressurized inert gas can be conveyed to the oven chamber 45 when the transportable oven 40 is connected to the vacuum furnace 20.

The transportable oven 40 is connected to the remote gas supply via a hose having a quick release fitting. An arrangement of pressure reducing valves, not shown, reduce the pressure of the gas to the desired operating pressure within the oven, preferably 1 psig. The inert gas reserve system 76 provides inert gas when the transportable oven 40 is disconnected from the vacuum furnace gas supply. The gas reserve system is mounted on the transportable oven, and includes one or more bottles of inert gas and a separate arrangement of pressure reducing valves to reduce the pressure of the bottled gas to the desired operating pressure.

The oven heating means comprises a plurality of heating elements 62 which are preferably electric resistance type heating elements. A heating element controller 61 is provided for controlling operation of the heating elements to provide a desired temperature in the oven chamber 45. The heating element controller 61 also monitors the temperature of the oven to ensure that the temperature does not fall below a preselected lower temperature limit. The lower temperature limit is selected based on the material composition of the workpiece 5 and/or the type of processing to be performed on the workpiece.

A convection fan 63 is mounted on the ceiling of oven chamber 45 to provide uniform heat distribution in the oven chamber 45 by continuously displacing the inert gas, and thereby forcing the inert gas to flow over the heating elements 62 and the workpiece 5. Baffles 64 surround the oven chamber to direct the flow of the heated gas. The transportable oven 40 also includes thermal insulation 65 to slow the loss of heat and thereby reduce the amount of heat that must be supplied by the heating elements 62 to maintain the workpiece 5 at the desired temperature. In the preferred embodiment, the insulation is a rigidized board layer of ceramic fiber insulation and a backing layer of non-rigid ceramic fiber insulation.

Oven doors 56 are movably mounted on the open end of the transportable oven 40. The doors 56 can be positioned to close off the opening 50 so that a positive pressure of inert gas can be maintained in the oven when it is disconnected from the vacuum furnace 20. In the embodiment shown the transportable oven 40 has two doors 56 which slide in door tracks 57. The door tracks 57 constrain the translational and rotational displacement of the doors. The doors 56 and tracks 57 are constructed and arranged to be opened or closed while the transportable oven 40 is connected to the vacuum furnace 20.

Wheels 82 are provided so that the transportable oven 40 can be readily transported to another location where the workpiece will be further processed. In the embodiment shown, the oven 45 has four wheels 82, preferably casters. Four air floats 85 are also provided and operate to elevate the oven on a layer of air to provide greater mobility than the wheels would otherwise provide.

Figure 6:
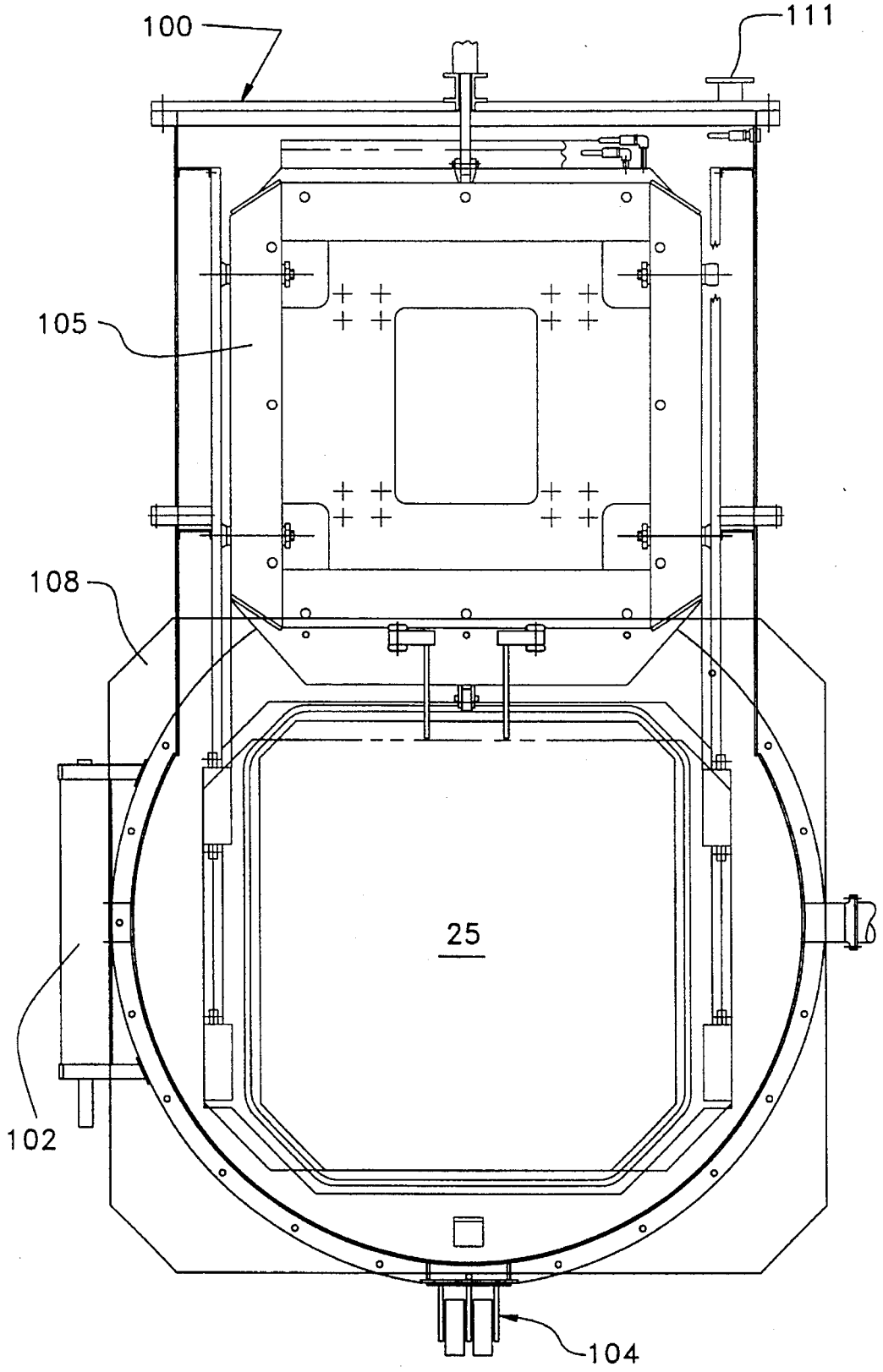
FIG. 6 is a front elevation view of a gate valve assembly used in connection with the hybrid vacuum furnace shown in FIG. 1.
Figure 7:
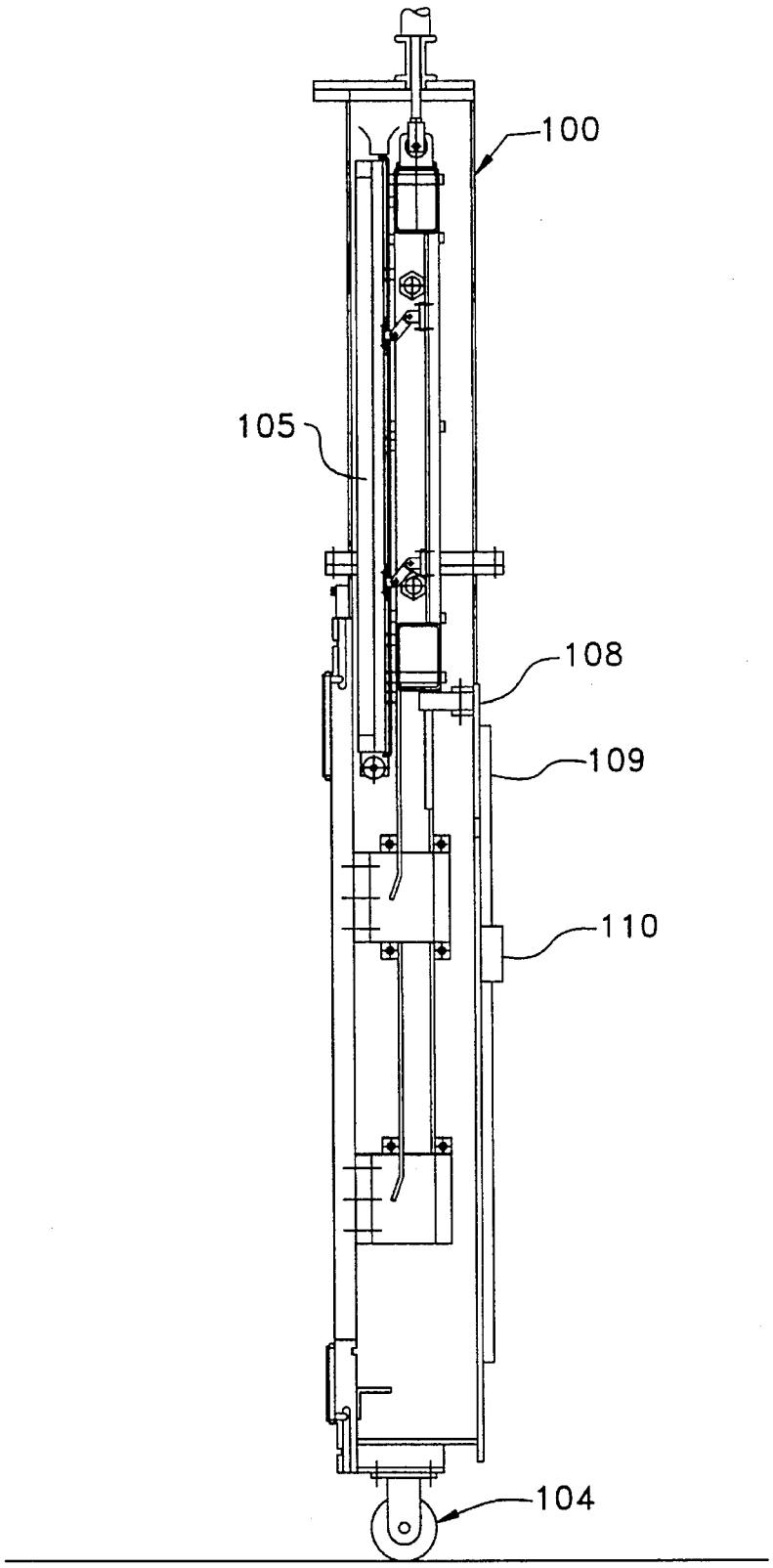
FIG. 7 is a side elevation view of the gate valve assembly shown in FIG. 5.
Figure 8:
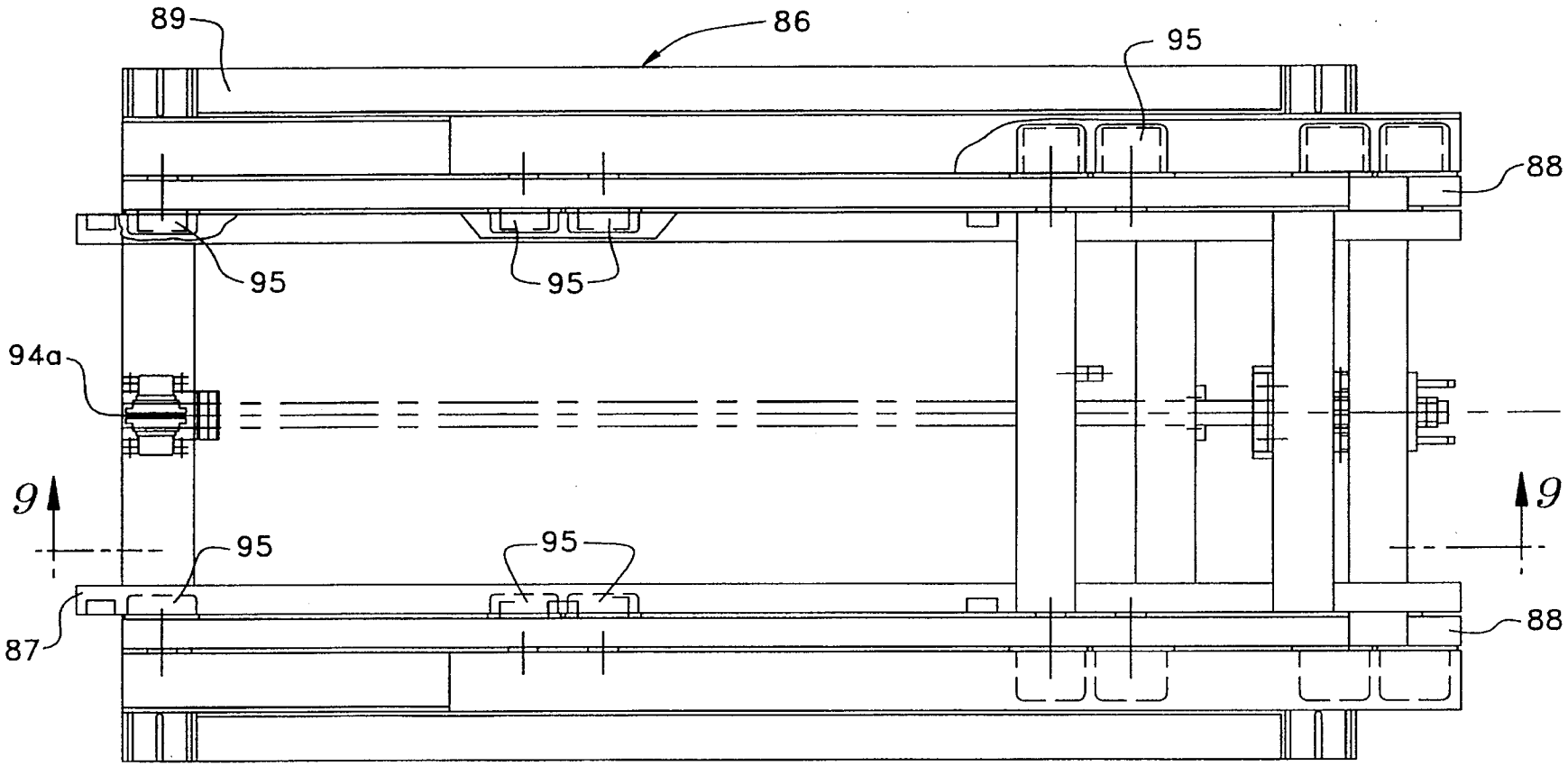
FIG. 8 is a top plan view of a transfer assembly used in the hybrid vacuum furnace of FIG. 1.
Figure 9:
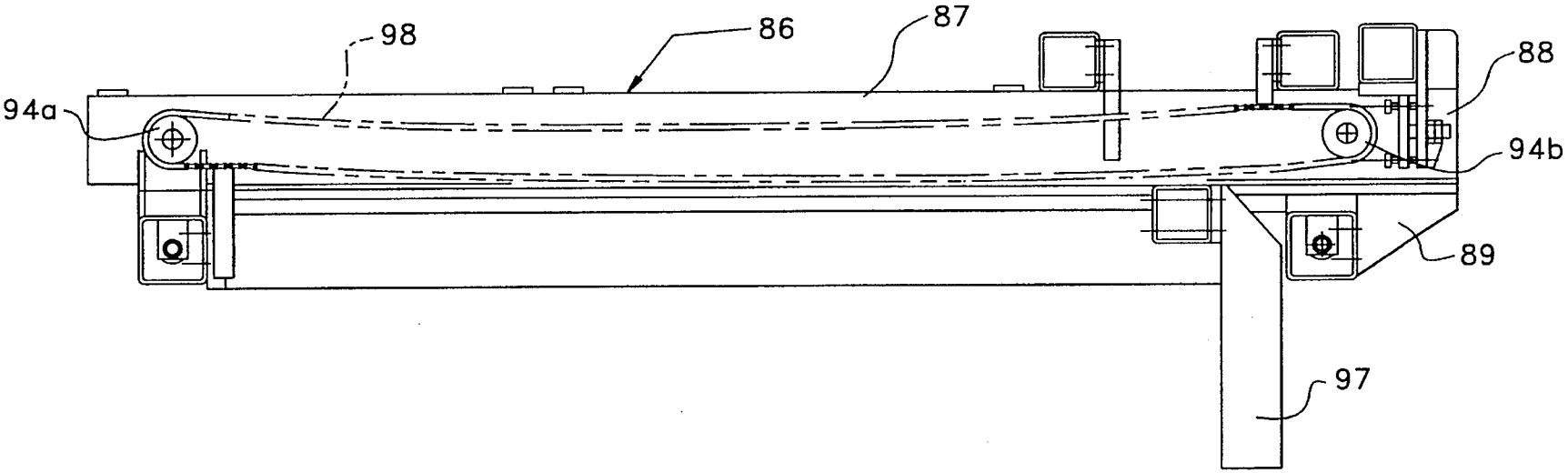
FIG. 9 is a side elevation view in partial section of the transfer assembly shown in FIG. 7, as viewed along line 9—9.

Referring now to FIGS. 6 and 7, the gate valve assembly 100 is attached to the vacuum furnace 20 by a hinge assembly 102. The hinge assembly 102 permits the gate valve assembly 100 to be swung between an opened position and a closed position. A pair of wheels 104 is mounted to the bottom of gate valve assembly 100 to support a portion of its weight thereby facilitating the moving the gate valve assembly 100 between the opened position and the closed position.

A sealing door or gate 105 is slidably mounted in the gate valve assembly 100 so the it can be raised to an opened position or lowered to a closed position. In the closed position the gate 105 covers the opening 25 in the heating chamber 24. The gate valve assembly 100 is constructed and arranged to provide a vacuum tight seal when the gate valve assembly 100 and the gate 105 are both in the closed positions. Such gate valves are known in the art and a representative arrangement for a gate valve is shown and described in U.S. Pat. No. 3,399,875 which is incorporated herein by reference.

The other side of gate valve 100 faces the transportable oven 40. A flange 108 is formed to mate with the open end of the transportable oven 40 in sealing engagement to prevent the introduction of air into the transportable oven 40 or the furnace 20 when the transportable oven 40 is connected to the gate valve assembly 100. To that end the flange 108 includes two clamps 110 and a seal 109, which is preferably an inflatable seal disposed in flange 108. The transportable oven 40 is connected to the gate valve assembly 100 by bringing the open end of the oven 40 into mating contact with the inflatable seal 109, closing the clamps 110 and then inflating the seal 109.

The gate valve assembly 100 also includes a gas inlet 111 so that pressurized inert gas can be introduced into the gate valve assembly after the oven 40 has been attached. This arrangement provides an inert atmosphere that prevents the workpiece 5 from being oxidized when it is transferred through the gate valve assembly 100.

Operation of the hybrid vacuum furnace according to the present invention proceeds as follows. A workpiece 5 is loaded into the heating chamber 24 of vacuum furnace 20. The sealing gate 105 is lowered into its closed position to seal-off the heating chamber 24. The heating chamber 24 is then evacuated to a subatmospheric pressure and the workpiece 5 is heated to a first elevated temperature. The first elevated temperature is selected based on the material composition of the workpiece and with consideration of the processing to be done on the workpiece after it has been heat treated. During the heat treating process, the transportable oven 40 is connected to the gate valve assembly 100 as described hereinabove and the oven doors 56 are closed.

After connecting the oven 40 to an electrical supply, the heating elements 62 are turned on and the oven chamber 45 is heated to the warming temperature. The warming temperature is lower than the first elevated temperature, but significantly higher than room temperature. For many steel alloys the warming temperature is between 300° and 650° F.

The inert gas inlet 111 on the gate valve assembly 100 and the oven gas connection are connected to the vacuum furnace inert gas supply and inert gas is introduced into the gate valve assembly 100 and the oven chamber 45. The pressure of the inert gas in the gate valve 100 and the oven chamber 45 is raised to above atmospheric pressure so that any leakage past the inflatable seal 109 will be outward to the ambient atmosphere. In this manner air is prevented from leaking into the oven chamber 45. However, the pressure of the inert gas should not be so high as to cause the inflatable seal 109 to fail. Preferably, the inert gas pressure is maintained at approximately 1 psig within the oven chamber 40. While the gas is introduced to the oven chamber, the fan 63 is turned on to circulate the gas to provide and maintain a uniform temperature distribution within the oven chamber.

After the heat treating cycle is completed, the vacuum furnace temperature is reduced to the warming temperature. As generally known, inert gas can be introduced to the heating chamber 24 and circulated by a motor driven fan to reduce the temperature more rapidly. When the furnace temperature reaches the desired working temperature, the pressure of the inert gas in the furnace heating chamber 24 is adjusted to about the pressure in the gate valve assembly 100 and the oven chamber 45.

After the pressure in the heating chamber 24 is equalized with that in the gate valve assembly 100 and oven chamber 45, the oven doors 56 and the vacuum seal door 105 are opened. The transfer mechanism 86 is operated to extend into the heating chamber 24, lift the workpiece 5, and then retract into the oven chamber 45 with the workpiece. The oven doors 56 are then closed and the clamps 110 are released, so that the oven 40 can be detached from the gate valve assembly 100. The oven is disconnected from the vacuum furnace gas supply and the electrical supply.

Once disconnected from the vacuum furnace 20, the oven 45 is transported to a work station for further processing. Once the oven reaches the next processing station, it can be connected to a second electrical supply to energize the heating elements 62 and maintain the warming temperature within the heating chamber 24. Additionally, as the pressure within the oven decreases, the gas reserve 76 operates to supply inert gas to the oven chamber to maintain the proper gas pressure. When the workpiece is ready to be processed, the oven doors 56 are opened and the workpiece 5 is removed and placed on the forge or other hot forming device.

Some of the many novel features and advantages of the present invention are now apparent in view of the foregoing description. For example, a hybrid vacuum furnace has been described which includes a transportable oven that is adapted for holding a metallic workpiece that has been heat treated in the vacuum furnace. The transportable oven is also adapted to maintain the workpiece within a desired temperature range and to provide an inert atmosphere therein to inhibit oxide scale formation on the workpiece. In this manner the workpiece can be transported to a hot working apparatus such as a forge or press without being exposed to air. Moreover, it is not necessary to reheat the workpiece because it is maintained above its phase transition temperature. As will be readily appreciated by those familiar with the art, compared to the known furnaces and processes, the hybrid vacuum furnace according to this invention can provide significant savings in time and material in the manufacture of components from steel alloys that are vacuum heat treated prior to being hot formed.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. Apparatus for heat treating a workpiece comprising:

a vacuum furnace for heating a metallic workpiece to a first elevated temperature, said vacuum furnace including a heating chamber and an opening for inserting a workpiece into or removing a workpiece from said heating chamber;

sealing means connected to said vacuum furnace for closing the vacuum furnace opening and preventing the introduction of air into the heating chamber while the workpiece is being heated in said vacuum furnace; and an oven removably connected to said sealing means comprising:

an oven chamber for holding the workpiece, said oven chamber having an opening at one end thereof for inserting a workpiece into or removing a workpiece from said oven chamber;

oven closing means for closing the opening of said oven chamber and for preventing the introduction of air into the oven chamber while said oven is disconnected from said vacuum furnace; and heating means for maintaining the workpiece in said oven chamber above a second elevated temperature when said oven is disconnected from said furnace.

2. Heat treating apparatus according to claim 1 wherein said oven includes transportation means for transporting said oven to an area remote from said furnace.

3. Heat treating apparatus according to claim 2 wherein said transportation means comprises an air float that elevates said oven on a layer of air.

4. Heat treating apparatus according to claim 2 wherein said oven chamber further comprises an oven gas supply to introduce inert fluid to the oven chamber and to maintain the oven chamber atmosphere at a greater pressure than the pressure outside said oven chamber.

5. Heat treating apparatus according to claim 1 wherein said heating means is electrically powered having a means for adjustably varying the amount of heat supplied to said oven chamber.

6. Heat treating apparatus according to claim 1 wherein said oven includes insulating means for slowing the heat loss from said oven chamber.

7. Heat treating apparatus according to claim 1 further including a means for transferring the workpiece from said furnace chamber to said oven chamber.

8. Apparatus for heat treating a metallic workpiece comprising:

a vacuum furnace for heating a workpiece to a first elevated temperature, said vacuum furnace including a heating chamber and an opening for inserting a workpiece into or removing a workpiece from said heating chamber;

sealing means connected to said vacuum furnace for closing the vacuum furnace opening and preventing the introduction of air into the heating chamber while the workpiece is being heated in said vacuum furnace; and an oven removably connected to said sealing means comprising:

an oven chamber for holding the workpiece, said oven chamber having an opening at one end thereof for inserting a workpiece into or removing a workpiece from the oven chamber;

oven closing means for closing the opening of said oven chamber and preventing the introduction of air into the oven chamber while said oven is disconnected from said vacuum furnace;

transportation means for transporting said oven to an area remote from said furnace;

insulating means for slowing the heat loss from said oven chamber.

9. Heat treating apparatus according to claim 8 wherein said oven chamber further comprises an oven gas supply to introduce inert fluid to the oven chamber and to maintain the oven chamber atmosphere at a greater pressure than the pressure outside said oven chamber.

10. Heat treating apparatus according to claim 8 further including a means for transferring the workpiece from said furnace chamber to said oven chamber.

11. A hybrid furnace comprising:

a vacuum furnace for heating a workpiece to a first elevated temperature in an evacuated atmosphere, said furnace including a furnace chamber, and an opening providing access to said furnace chamber;

an oven removably connected to said furnace comprising:

an oven chamber for storing the workpiece, said oven chamber having an opening at one end thereof;

an oven gas supply to introduce inert fluid to the oven chamber and to maintain the oven chamber atmosphere at a greater pressure than the pressure outside said oven chamber;

oven closing means for covering the opening of said oven chamber, preventing the introduction of air into the oven chamber while said oven is disconnected from said furnace; and heating means for maintaining the workpiece in said oven chamber above a second elevated temperature when said oven is disconnected from said furnace;

transportation means for transporting said oven to an area remote from said furnace;

insulating means for slowing the heat loss from said oven chamber; and furnace sealing means connected to said furnace for preventing the introduction of air into the oven chamber and the furnace chamber while said oven is connected to said furnace.

12. A method for transferring a workpiece from a furnace to a processing station without exposing the workpiece to an oxidizing atmosphere comprising the steps of:

heating a metallic workpiece to a first elevated temperature in a vacuum furnace;

cooling the workpiece in the vacuum furnace to a second elevated temperature lower than said first elevated temperature;

transferring the workpiece to a transportable oven while the workpiece is at the second elevated temperature, said transferring being conducted without exposing the workpiece to an oxidizing atmosphere;

closing said transportable oven to prevent the workpiece from being exposed to an oxidizing atmosphere;

moving said transportable oven to a work station for further processing;

heating the workpiece in said transportable oven while it is at the work station to maintain the workpiece above the second elevated temperature.

13. The method according to claim 12 further comprising the step of providing an inert atmosphere in the transportable oven to prevent oxidation of the metallic workpiece.

14. The method according to claim 13 wherein the step of providing the inert atmosphere in the transportable oven comprises the step of injecting an inert gas into the transportable oven.

15. The method of claim 12 further comprising the steps of connecting the transportable oven to the vacuum furnace, injecting an inert gas into the vacuum furnace, and raising the pressure of the inert gas in the vacuum furnace to equalize the pressure in the vacuum furnace and the inert gas pressure in of the transportable oven.

16. The method of claim 12 further comprising the step of heating the transportable oven to said second temperature prior to transferring the workpiece from the vacuum furnace to the transportable oven.

* * * * *